US008763836B2

(12) United States Patent
Becklin

(10) Patent No.: US 8,763,836 B2
(45) Date of Patent: Jul. 1, 2014

(54) MODULAR EQUIPMENT CASE WITH SEALING SYSTEM

(75) Inventor: Dennis M. Becklin, Grants Pass, OR (US)

(73) Assignee: Becklin Holdings, Inc., Reno, NV (US)

( * ) Notice: Subject to any disclaimer, the term of this patent is extended or adjusted under 35 U.S.C. 154(b) by 1573 days.

(21) Appl. No.: 12/330,404

(22) Filed: Dec. 8, 2008

(65) Prior Publication Data

US 2010/0140270 A1 Jun. 10, 2010

(51) Int. Cl.

| | |
|---|---|
| ***B65D 55/14*** | (2006.01) |
| ***A44B 11/10*** | (2006.01) |
| *E05C 3/14* | (2006.01) |
| *E05B 5/02* | (2006.01) |

(52) U.S. Cl.

CPC . *A44B 11/10* (2013.01); *E05C 3/14* (2013.01); *B65D 2543/0049* (2013.01); *E05B 5/003* (2013.01)

USPC ..... 220/210; 220/761; 220/23.83; 220/378; 220/324; 220/315; 292/39; 292/172; 292/142

(58) Field of Classification Search

CPC .. E05C 3/14; A44B 11/10; B65D 2543/0049; E05B 5/003

USPC ..... 220/761, 23.83, 315, 324, 210, 378, 220/260, 245; 206/508, 509, 511, 512, 710; 292/39, 37, 33, 32, 279, 172, 142; 70/77, 163, 167, 118–120; 105/280, 105/286; 49/348, 350, 480.1, 358, 359, 49/275.1

See application file for complete search history.

(56) References Cited

U.S. PATENT DOCUMENTS

| | | | | |
|---|---|---|---|---|
| 879,455 | A | | 2/1908 | Frost |
| 1,708,616 | A | * | 4/1929 | Grimm ..... 192/223.3 |
| 2,271,952 | A | * | 2/1942 | Raus ..... 114/117 |
| 2,695,115 | A | | 11/1954 | Roop |
| 2,849,151 | A | | 8/1958 | Heil |
| 2,939,603 | A | | 6/1960 | Young |
| 3,072,287 | A | * | 1/1963 | Sampson ..... 220/309.2 |
| 3,103,278 | A | | 9/1963 | Kuzma et al. |
| 3,117,692 | A | | 1/1964 | Carpenter et al. |
| 3,224,066 | A | * | 12/1965 | Overland ..... 27/17 |
| 3,383,009 | A | | 5/1968 | Weikert |
| 3,391,824 | A | | 7/1968 | Wiseman |
| 3,419,184 | A | | 12/1968 | Asenbauer |
| 3,481,502 | A | | 12/1969 | Slayman |
| 3,616,943 | A | | 11/1971 | Brink |
| 3,754,645 | A | | 8/1973 | Kilroy |

(Continued)

FOREIGN PATENT DOCUMENTS

| | | |
|---|---|---|
| EP | 0129860 | 1/1985 |

*Primary Examiner* — Andrew Perreault
*Assistant Examiner* — James M Van Buskirk
(74) *Attorney, Agent, or Firm* — Lowe Graham Jones PLLC

(57) ABSTRACT

A container includes a sealing system coupled to an interior surface of the container's lid or cover. The sealing system includes a rotatable latch that, when rotated, cooperates with a number of gears to and a cam assembly formed in the lid to actuate a number of arms or links. In one embodiment, some of the arms extend approximately radially from a driven gear and operate to move an engagement member of the sealing assembly into contact with a complementary engagement member coupled to a base portion of the container. This engagement, in turn, compresses a seal or gasket located between the lid portion and the base portion of the container.

24 Claims, 10 Drawing Sheets

(56) References Cited

U.S. PATENT DOCUMENTS

| | | | | | |
|---|---|---|---|---|---|
| 3,756,396 | A | | 9/1973 | Kilroy | |
| 3,759,416 | A | | 9/1973 | Constantine | |
| 3,811,747 | A | | 5/1974 | Levin | |
| 3,968,879 | A | | 7/1976 | Lucas, Sr. et al. | |
| 4,037,440 | A | * | 7/1977 | Shabtai et al. | 70/108 |
| 4,154,070 | A | * | 5/1979 | Bahry et al. | 70/108 |
| 4,287,997 | A | | 9/1981 | Rolfe et al. | |
| 4,408,546 | A | * | 10/1983 | Schmidt | 109/75 |
| 4,765,252 | A | * | 8/1988 | Shuert | 108/55.1 |
| 4,832,200 | A | | 5/1989 | Deaton et al. | |
| 4,848,605 | A | | 7/1989 | Wise | |
| 4,976,635 | A | * | 12/1990 | Gottardo et al. | 439/849 |
| 4,984,832 | A | * | 1/1991 | Canepa | 292/36 |
| 5,042,674 | A | | 8/1991 | Ramsay et al. | |
| 5,094,483 | A | * | 3/1992 | James | 292/39 |
| D333,094 | S | | 2/1993 | Zutler | |
| 5,203,494 | A | | 4/1993 | Blomfield | |
| 5,392,945 | A | | 2/1995 | Syrek | |
| D361,715 | S | | 8/1995 | Haupert | |
| 5,454,477 | A | | 10/1995 | Bornhorst et al. | |
| 5,641,090 | A | | 6/1997 | Kowalski et al. | |
| 5,718,350 | A | | 2/1998 | Williams | |
| 5,769,230 | A | | 6/1998 | Koefelda | |
| 5,779,051 | A | | 7/1998 | Boutin | |
| 6,021,916 | A | | 2/2000 | Stolzman | |
| 6,085,467 | A | | 7/2000 | Packrall et al. | |
| 6,186,345 | B1 | | 2/2001 | Robertson | |
| 6,237,758 | B1 | | 5/2001 | Hsu | |
| D446,017 | S | | 8/2001 | Koefelda | |
| 6,308,858 | B1 | | 10/2001 | Koefelda | |
| 6,367,630 | B1 | | 4/2002 | Elskamp | |
| 6,371,364 | B1 | | 4/2002 | Maillot et al. | |
| 6,457,599 | B1 | | 10/2002 | Apps et al. | |
| 6,585,090 | B2 | | 7/2003 | Harvey | |
| 6,662,950 | B1 | | 12/2003 | Cleaver | |
| D500,924 | S | | 1/2005 | Martin et al. | |
| 7,163,122 | B2 | | 1/2007 | Elder et al. | |
| 7,850,751 | B2 | * | 12/2010 | Steiner | 55/385.1 |
| 2004/0178208 | A1 | | 9/2004 | Leba et al. | |
| 2006/0254946 | A1 | | 11/2006 | Becklin | |
| 2006/0254947 | A1 | | 11/2006 | Rogers | |
| 2008/0029011 | A1 | * | 2/2008 | Czarnowski et al. | 114/203 |

* cited by examiner

MODULAR EQUIPMENT CASE WITH SEALING SYSTEM

BACKGROUND OF THE INVENTION

Various types of containers for moving equipment, such as electronics equipment or other types of delicate devices and systems, have been employed in military and commercial environments. Such containers are often moved frequently via ship, truck, airplane and some other vehicle. These containers may be subjected to a variety of environmental conditions during transit and generally are sealed to sufficiently isolate the equipment within the container from such conditions. In addition, these containers include one or more latches on each side of the container to seal a lid portion to a base portion. By way of example, one such container is described in U.S. Patent Publication No. 2006/0254946 to Becklin.

SUMMARY OF THE INVENTION

A container includes a sealing system coupled to an interior surface of the container's lid or cover. The sealing system includes a rotatable latch that, when rotated, cooperates with a number of gears and a cam assembly formed in the lid to actuate a number of arms or links. In one embodiment, some of the arms extend approximately radially from a driven gear and operate to move an engagement member of the sealing assembly into contact with a complementary engagement member coupled to a base portion of the container. This engagement, in turn, compresses a seal or gasket located between the lid portion and the base portion of the container.

In one example of the invention, an equipment container includes a base portion forming a containment space to receive equipment and a molded lid portion coupleable to the base portion. The molded lid portion includes a plurality of guide channels and a cam assembly. The container further includes a sealing system located proximate an interior surface of the molded lid portion. The sealing system includes a rotatable external latch coupled to a drive gear; a driven gear engaging the drive gear; and a linkage assembly. The linkage assembly includes first links pivotally coupled to the driven gear and second links each having first end portions pivotally coupled to the respective first links and second end portions received by the respective guide channels, the linkage assembly further having movable internal latch mechanisms coupled to the second end portions of the second links, the movable internal latch mechanisms operable to sealingly compress a seal located between the base portion and the molded lid portion with a desired amount of rotation applied to the rotatable external latch.

In another example of the invention, a sealing system for a container having a lid portion and a base portion includes a rotatable latch coupled to a drive gear; a driven gear engaged with the drive gear; a linkage assembly having first links pivotally coupled to the driven gear and second links each having first end portions pivotally coupled to the respective first links and second end portions coupled to an engagement system that operates to seal the container, the engagement system having a deformable tang coupled to a lid portion of the container and configured to engage a bracket coupled to a base portion of the container.

In yet another example of the invention, a method for sealing a container includes the steps of (1) moving a latch mechanism into a rotatable position; (2) rotating the latch mechanism in a first rotational direction, the latch mechanism coupled to a drive gear; (3) moving a linkage assembly through rotation of the drive gear, the linkage assembly having a primary arm and a secondary arm; (4) moving a deformable tang into engagement with a fixed bracket, the deformable tang coupled to a first portion of the container and the fixed bracket coupled to a second portion of the container; and (5) compressing a seal located at an interface of the first portion the second portion of the container.

BRIEF DESCRIPTION OF THE DRAWINGS

In the drawings, identical reference numbers identify similar elements or acts. The sizes and relative positions of elements in the drawings may not be necessarily drawn to scale. For example, the shapes of various elements and angles may not be drawn to scale, and some of these elements may be arbitrarily enlarged or positioned to improve drawing legibility.

The preferred and alternative embodiments of the present invention are described in detail below with reference to the following drawings.

DETAILED DESCRIPTION OF THE PREFERRED EMBODIMENT

In the following description, certain specific details are set forth in order to provide a thorough understanding of various embodiments of the invention. However, one skilled in the art will understand that the invention may be practiced without these details. In other instances, well-known structures associated with containers, latches, sealing systems, cam assemblies, and methods of assembling the same have not necessarily been shown or described in detail to avoid unnecessarily obscuring descriptions of the embodiments of the invention.

In addition, throughout the specification and claims which follow, the term "container" is meant as a broad term that includes a variety of structures having an interior space sized to receive a variety of items, such as, but not limited to, electronics, optical, or other equipment that may be otherwise susceptible to damage if not properly packaged in the container. Further, the term "container" as used herein generally may include structurally rigid containers that may be stacked together.

Figure 1:
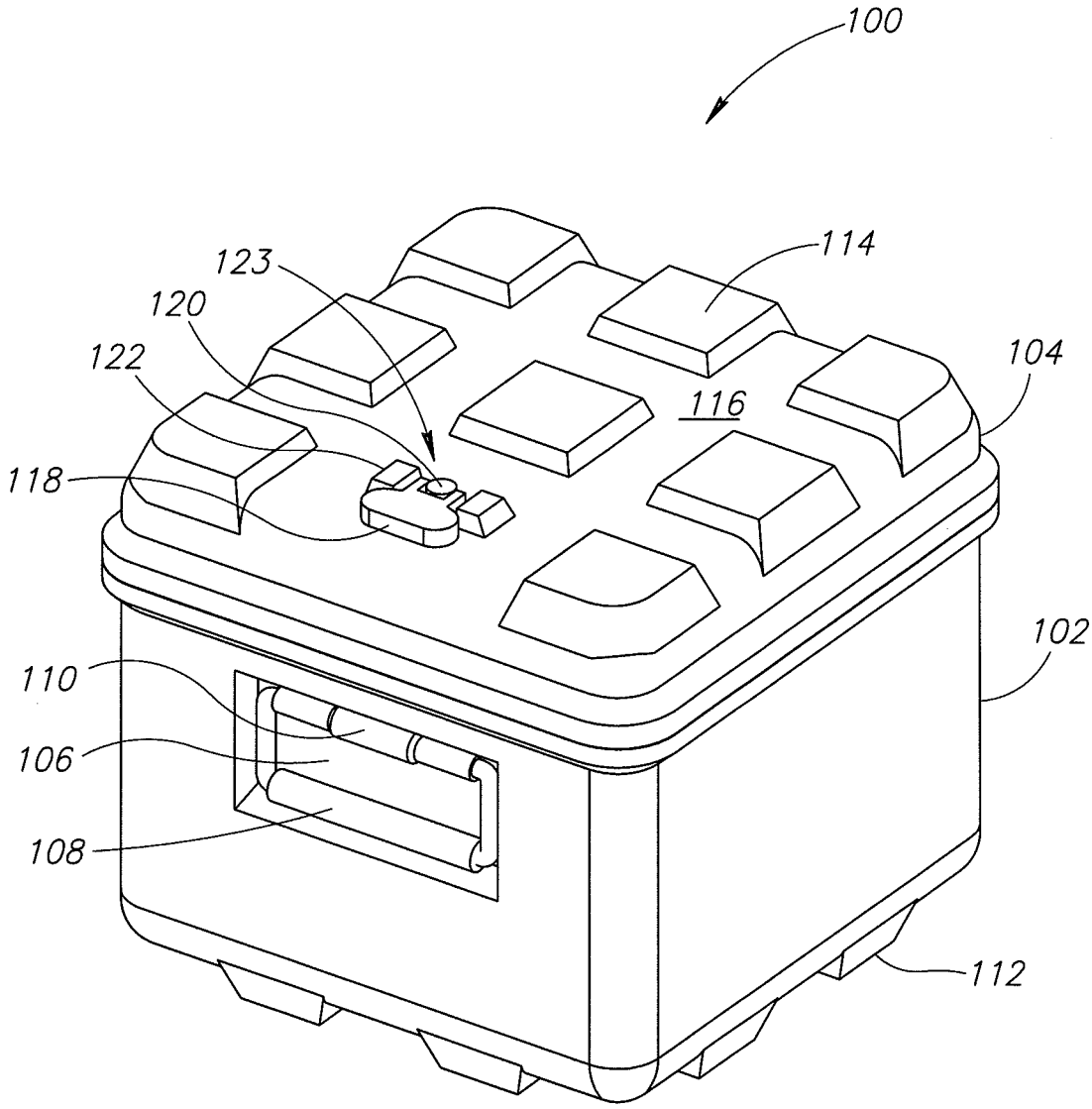
FIG. 1 is an isometric view of a container having a lid portion coupled to a base portion, the lid portion having a latch operatively coupled to a sealing system, the latch shown in a closed position, according to an embodiment of the present invention.

FIG. 1 shows a container 100 having a base portion 102 coupled to a lid portion 104. The container 100 may take the form of a structurally rigid equipment container operable to enclose equipment such as, but not limited to, electronics, optical, or other equipment. For purposes of the present invention, enclosing the equipment includes sealing the lid portion 104 to the base portion 102.

The base portion 102 includes a recessed portion 106 configured to receive a handle 108, which is hingedly coupled to the base portion 102 through a hinge 110. The recessed portion 106 is sized to permit unobstructed storage of the handle 108 when the container 100 is not being carried. In the illustrated embodiment, the base portion 102 includes stackable elements 112. In one embodiment, the stackable elements 112 may take the form of raised cleats as described in U.S. Patent Publication No. 2006/0254946 to Becklin and which is included herein by reference in its entirety.

In addition, the lid portion 104 may also include stackable elements 114 extending from a top surface 116. In one embodiment, the stackable elements 114 of the lid portion 104 may take the form of raised bosses as described U.S. Patent Publication No. 2006/0254946 to Becklin. Further, the arrangement of the stackable elements 112 of the base portion 102 and the stackable elements 114 of the lid portion 104 may be complementary to permit secure stacking on one container onto another container.

The lid portion 104 further includes a latch 118 pivotally coupled to a movable, biased pin 120. In the illustrated embodiment, the latch 118 is located between molded bosses 122, which are arranged to provide a channel 123 for the latch 118. To prevent the latch 118 from being rotated upward inadvertently, a topmost surface of the latch 118 in a closed position may be lower in elevation than a topmost surface of the molded bosses 122.

Figure 2:
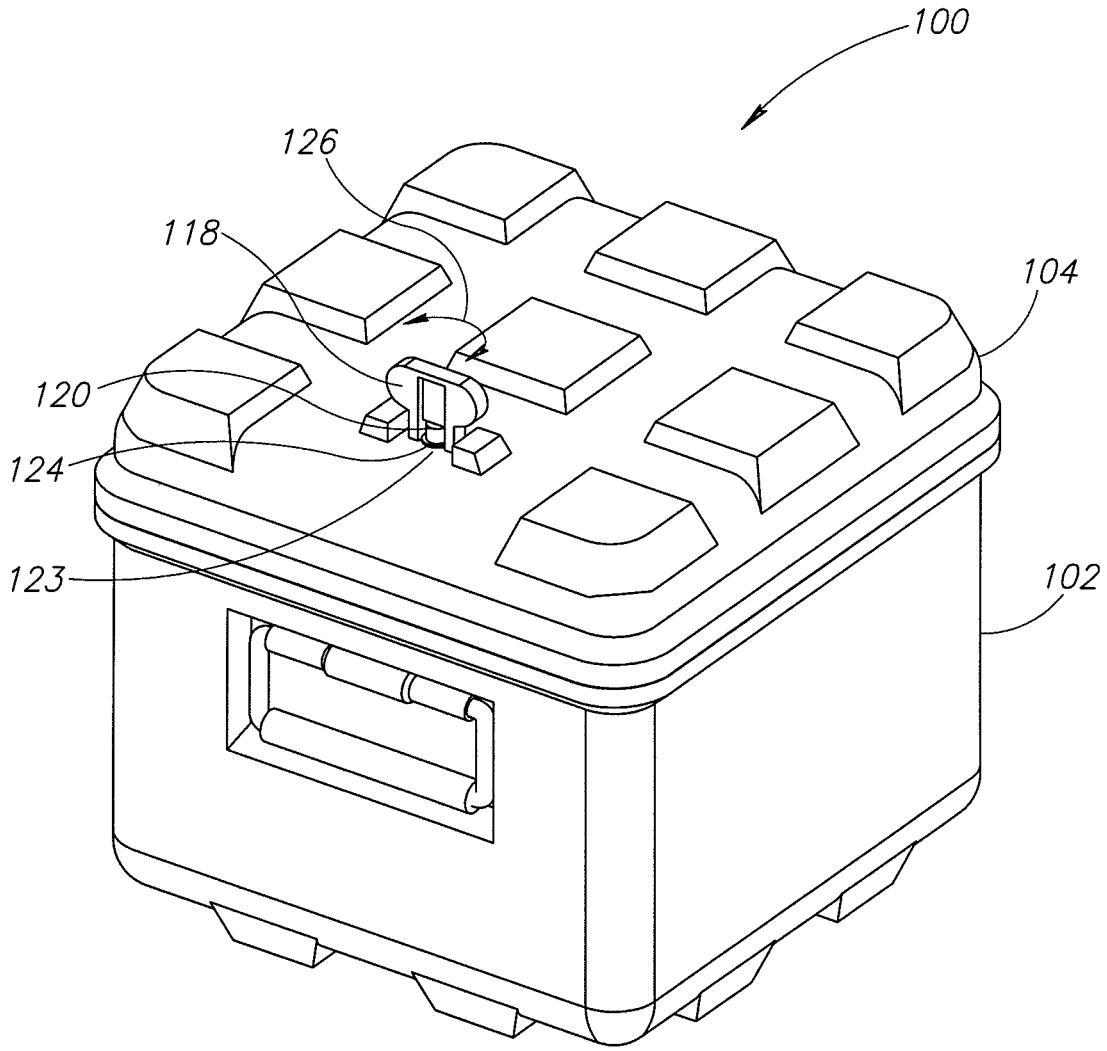
FIG. 2 is an isometric view of the container of FIG. 1 with the latch in a rotatable position, according to an embodiment of the present invention.

FIG. 2 shows the container 100 having the latch 118 in an open or rotatable position. The latch 118 may take the form of a wing-shaped or butterfly-shaped latch. In the illustrated embodiment, the movable, biased pin 120 is raised relative to the top surface 116 of the lid portion 104. A cap 124 may be located in the channel 123 and operate to cover a seal (FIG. 7) and an opening (FIG. 7) in the lid portion 104 that receives the pin 120. As described in greater detail below, the latch 118 operates as part of a sealing system 128 (FIG. 3) and further operates to actuate other components of the sealing system 128 to seal the lid portion 104 to the base portion 102 by manually rotating the latch 118 in one of a clockwise or counterclockwise direction 126 about the pin 120 when the latch 118 is in the open position.

Figure 3A:
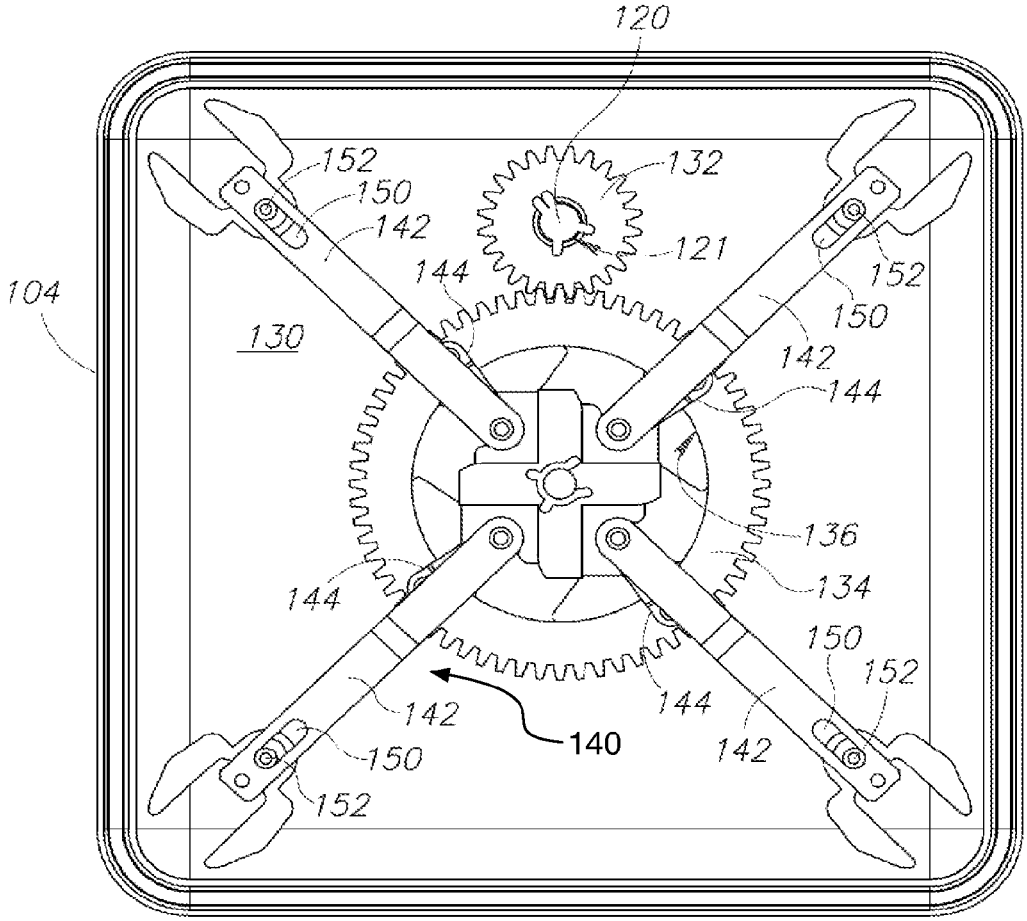
FIG. 3A is a plan view of an interior region of the lid portion of the container of FIG. 1 showing components of the sealing system that operate to seal the lid portion to the base portion, the sealing system shown in a sealed configuration, according to an embodiment of the present invention.
Figure 3B:
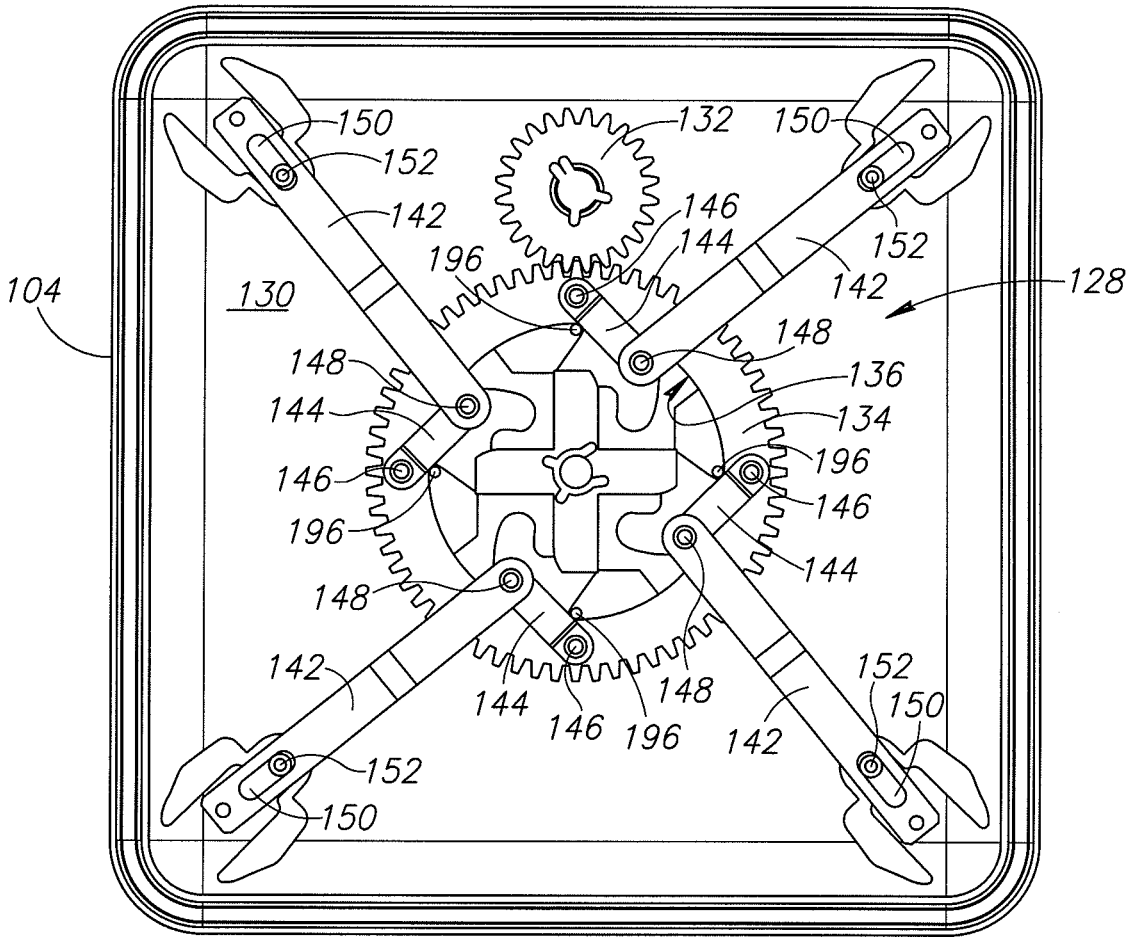
FIG. 3B is a plan view of the interior region of FIG. 3A showing the sealing system shown in a non-sealed configuration, according to an embodiment of the present invention.

FIGS. 3A and 3B show the sealing system 128 coupled to an interior surface 130 of the lid portion 104. The difference between FIGS. 3A and 3B is that in FIG. 3A the sealing system 128 is in a sealed configuration while in FIG. 3B it is in a non-sealed configuration. The sealing system 128 includes a drive gear 132, which is coupled to the latch 118 by way of the pin 120, and which may include flats 121 that secure the pin 120 to the drive gear 132. For purpose of clarity, the interaction between the latch 118 and the drive gear 132 will be described in greater detail below with respect to FIG. 7. A driven gear 134 engages the drive gear 132 and includes an inner diameter 136 sized to receive a cam assembly 138 (FIG. 8), which again, for purposes of clarity, will be described in greater detail below with respect to FIG. 8.

A linkage system 140 is pivotally coupled to the driven gear 134. In one embodiment, the linkage system 140 includes four primary arms 142 each coupled to four secondary arms 144 (best shown in FIG. 3B), respectively. The secondary arms 144, which are the smaller or shorter arms, are directly, pivotally coupled to the driven gear 134 through first pin connections 146. In turn, the primary arms 142 are directly, pivotally coupled to the secondary arms 144 through second pin connections 148. The primary arms 142 include slots 150 sized to receive stationary pins 152, which may be separately attached to or integrally molded with the lid portion 104.

Figure 4A:
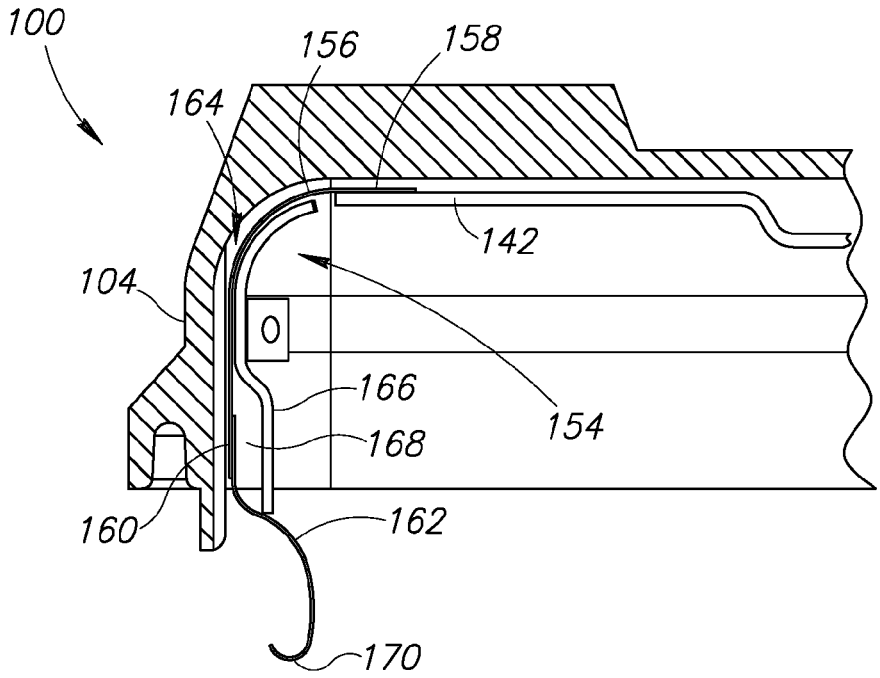
FIG. 4A is a cross-sectional view of a portion of the container of FIG. 1 showing a container sealing sub-assembly of the sealing system in a non-sealed configuration, according to an embodiment of the present invention.
Figure 4B:
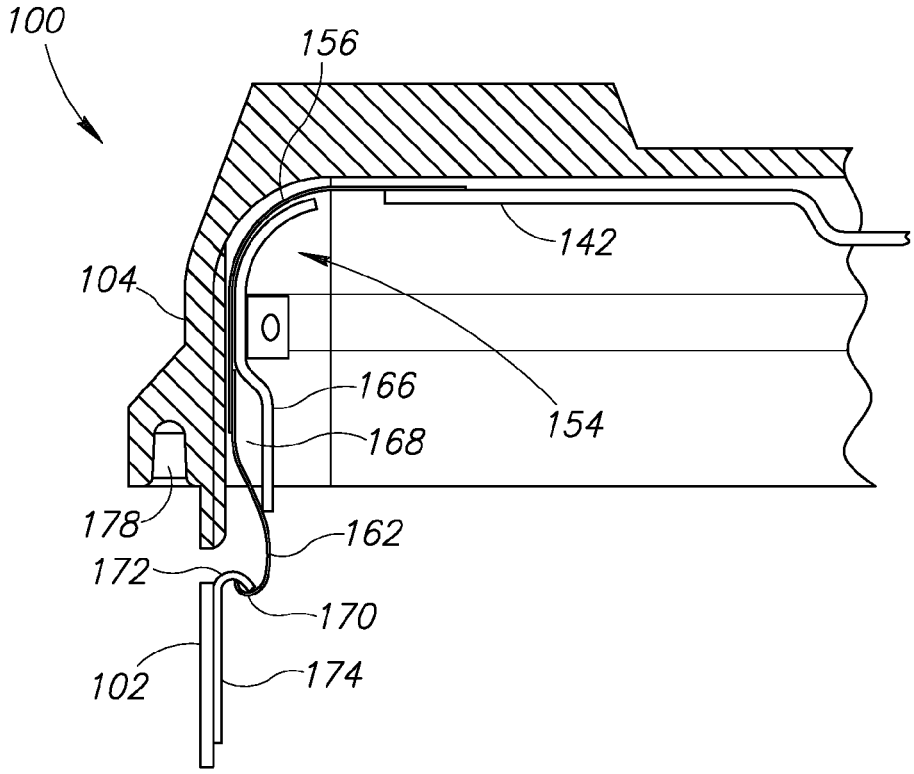
FIG. 4B is a cross-sectional view of the portion of the container of FIG. 4A showing the container sealing sub-assembly in a sealed configuration and engaged with the base portion of FIG. 1, according to an embodiment of the present invention.

FIGS. 4A and 4B show a corner portion of the container 100 and further show a container sealing sub-assembly 154, which may be considered part of the overall linkage system 140. The sealing sub-assembly 154 attaches to the primary arms 142 through arcuate-shaped sliders 156, each of which include a first end 158 coupled to its respective primary arm 142 and a second end 160 coupled to a malleable or deformable tang 162. The arcuate-shaped slider 156 may be configured to generally follow an interior contour of the interior surface 130 (FIG. 3A) of the lid portion 104. Further, the arcuate-shaped slider 156 is guided by a pathway 164 defined by the interior surface 130 (FIG. 3A) and a stationary pressure bracket 166.

As will be described in greater detail below, turning the latch 118 rotates the drive and driven gears 132, 134. In turn, the arms 142, 144 move from their positions shown in FIG. 3A to their positions shown in FIG. 3B. Because the primary arms 142 are coupled to the container sealing sub-assembly 154, movement of the primary arms 144 moves the arcuate-shaped slider 156 to pull the deformable tang 162 up into a cavity 168 formed between the stationary pressure bracket 166 and the interior surface 130 (FIG. 3A). A curved portion 170 of the deformable tang 162 then engages a curved portion 172 (FIG. 4B) extending from a base bracket 174 (FIG. 4B), which is fixed to the base portion 102 (FIG. 1).

Figure 5:
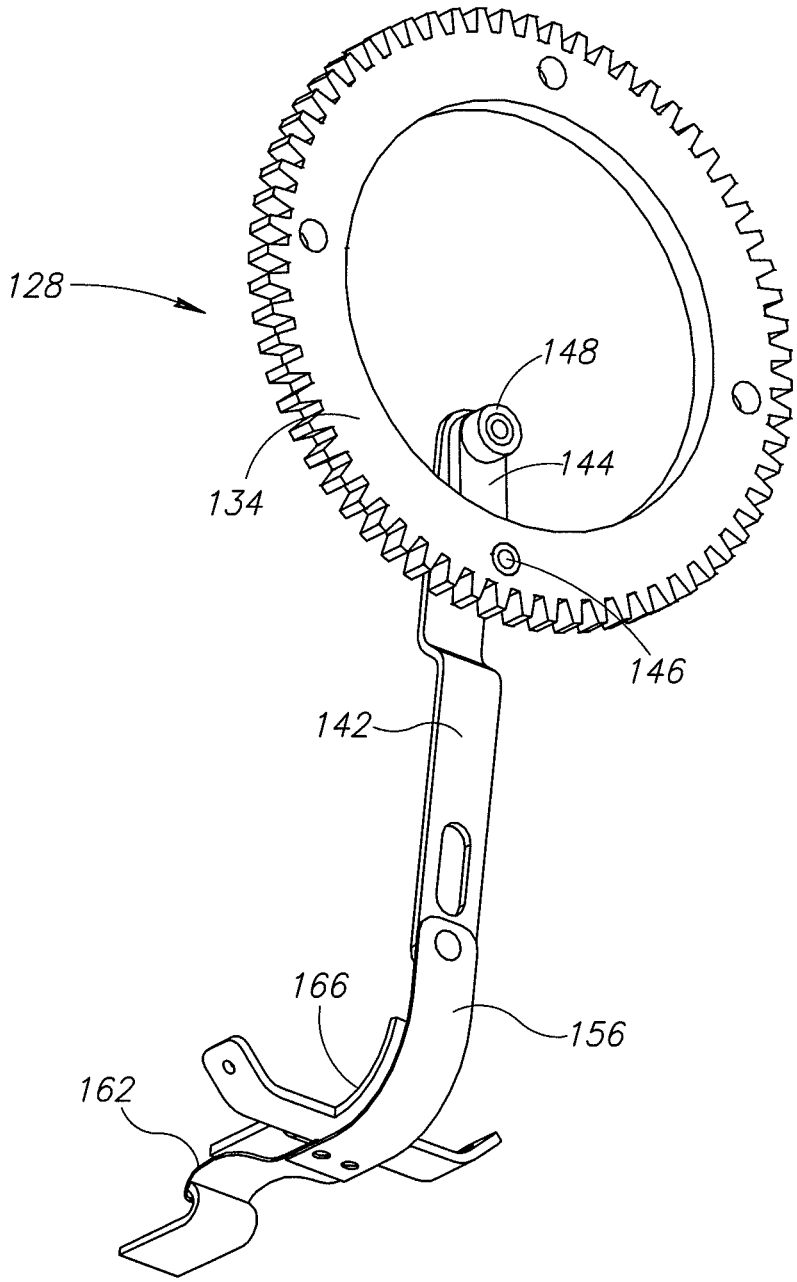
FIG. 5 is an isometric view of several of the components of the sealing system of FIGS. 3A-4B, according to an embodiment of the present invention.

For purposes of additional clarity, FIG. 5 shows some of the components of the sealing system 128 discussed above without illustrating portions of the container 100. Specifically, the driven gear 134 is coupled to the secondary arm 144 through the first pin connection 146 and also coupled to the primary arm 142 through the second pin connection 148. The primary arm 142 is fixed to the arcuate-shaped slider 156, which in turn is coupled to the deformable tang 162 that slides along the stationary pressure bracket 166 when being moved by the primary arm 142. The deformable tang 162 engages the base bracket 174, which is attached to the base portion 102 (FIG. 1), to seal the lid portion 104 (FIG. 1) with respect to the base portion 102 (FIG. 1).

Figure 6A:
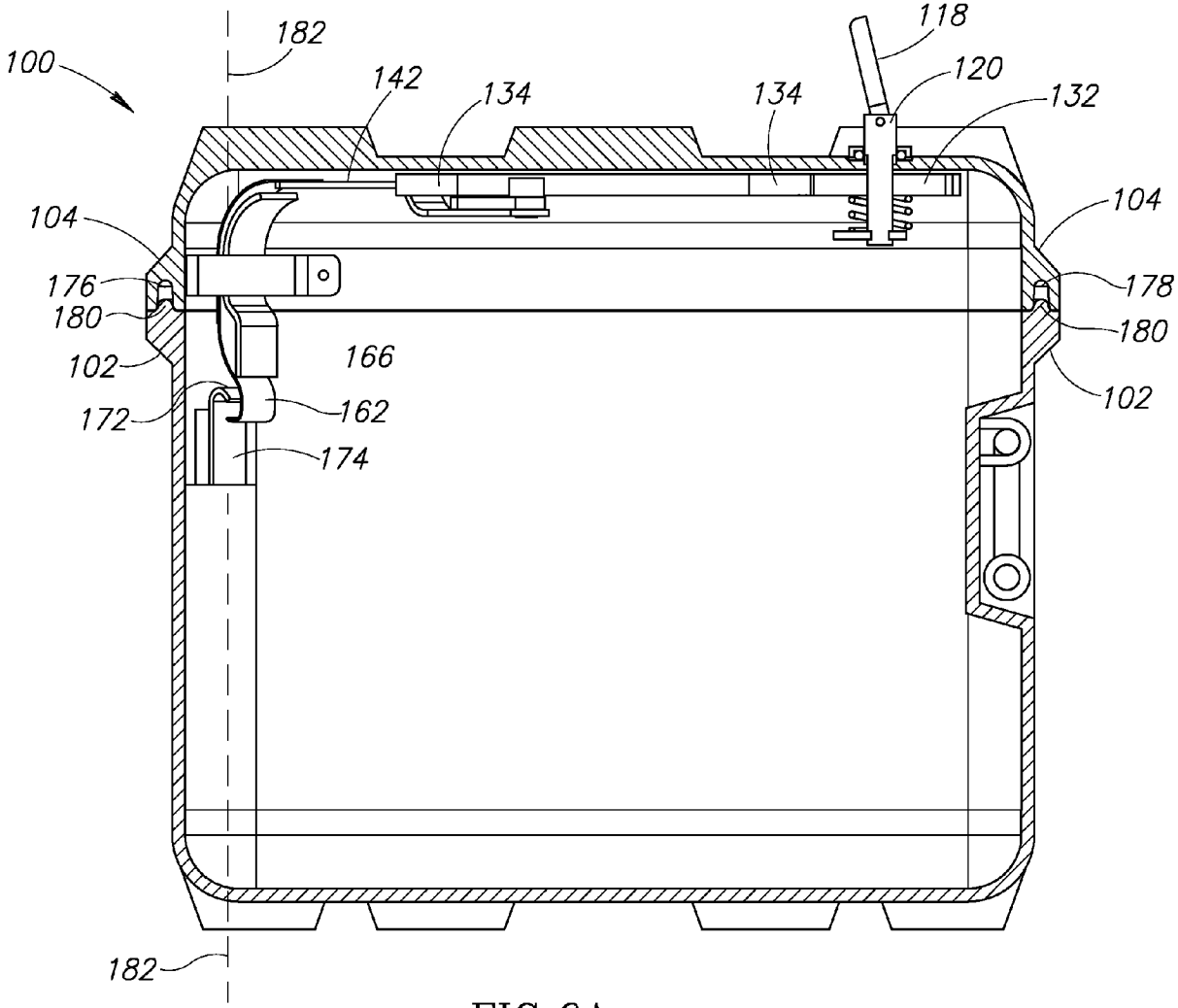
FIG. 6A is a cross-sectional view of the container of FIG. 2 showing container sealing sub-assembly in a non-sealed configuration, according to an embodiment of the present invention.
Figure 6B:
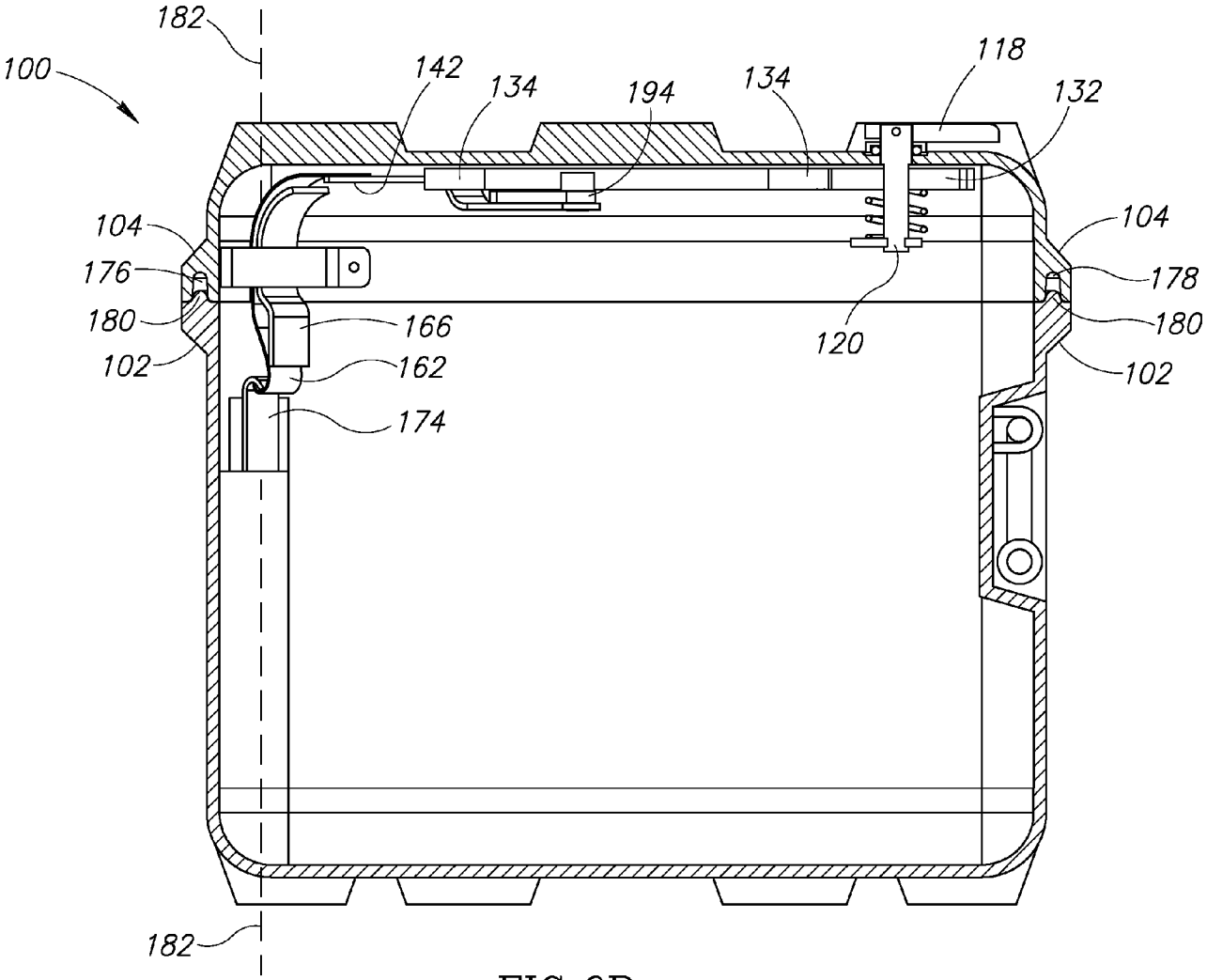
FIG. 6B is a cross-sectional view of the container of FIG. 1 showing container sealing sub-assembly in a sealed configuration, according to an embodiment of the present invention.

FIGS. 6A and 6B show the container 100 in a non-sealed configuration (FIG. 6A) and in a sealed configuration (FIG. 6B). Referring to FIG. 6A, a compressible member 176, which may take the form of an elastomeric gasket or seal, is located within a cavity 178 (best shown in FIG. 4B) formed in the lid portion 104. When the deformable tang 162 is drawn up under the stationary pressure bracket 166 by operation of the sealing system 128, a protruding member 180 extending from an end of the base portion 102 cooperates with the lid portion 104 to compress the compressible member 176. FIG. 6A shows the deformable tang 162 not engaged with the base bracket 174, thus the container is not sealed; whereas FIG. 6B shows the deformable tang 162 drawn up beneath the stationary pressure bracket 166, which creates tension along a line of action 182 (shown as a dashed line) extending longitudinally with respect to the tang/bracket 162/166 interface to seal the container 100.

Figure 7:
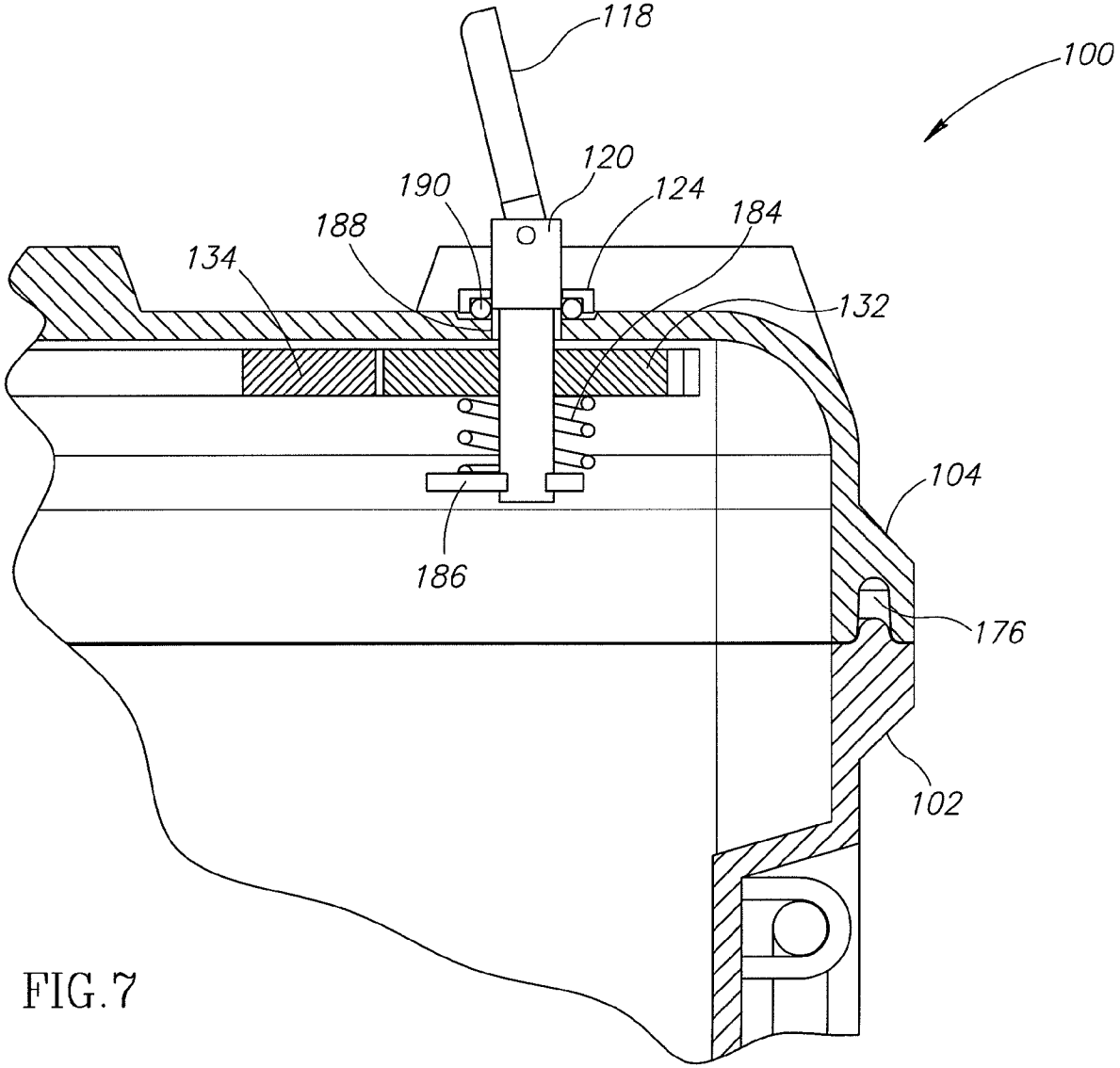
FIG. 7 is a cross-sectional view of a portion of the container of FIG. 2 showing the latch interaction with the drive gear, according to an embodiment of the present invention.

FIG. 7 shows the container 100 with the latch 118 in the rotatable position. The latch 118 rotates about the pin 120 to be moved into the rotatable position. A biasing member 184, which may take the form of a compression spring, located between a retainer plate 186 and the drive gear 132. The biasing member 184 operates to maintain the pin 120 and the drive gear 132 in alignment and further operates to seal the opening 188 in the lid portion 102, which in turn is covered by the cap 124. Sealing of the opening 188 may be accomplished with a latch seal 190, which may take the form of an o-ring seal.

To seal the container 100, the latch 118 may be rotated manually in one of either a clockwise or counterclockwise direction 126 (FIG. 2). During rotation, the flats 121 of the pin 120 engage the drive gear 132 and cause the drive gear to rotate, which in turn causes rotation of the driven gear 134.

Still referring to FIG. 7 and also referring back to FIGS. 3B and 4B, the rotation of the driven gear 134 causes the movement of the arms 142, 144. As the primary arms 142 move into a substantially perpendicular arrangement with the secondary arms 144, the primary arms 142 operate to move the deformable tang 162 into engagement with the base bracket 174. As described above, this engagement urges the lid portion 102 into tight contact with the base portion 104 and compresses the compressible member 176 to seal the container 100.

Figure 8:
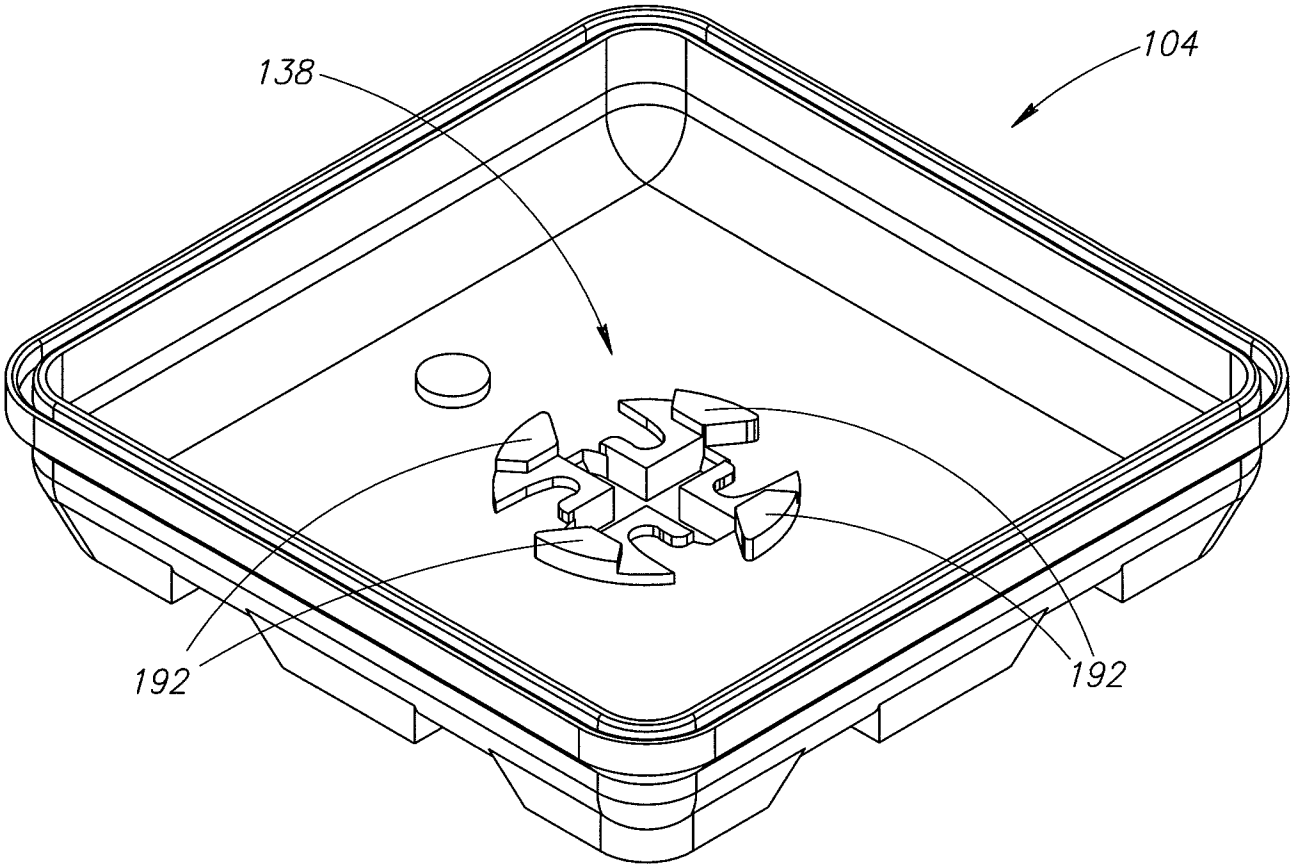
FIG. 8 is a plan view of an interior region of the lid portion of the container of FIG. 1 showing a cam assembly, according to an embodiment of the present invention.

FIG. 8 shows the cam assembly 138 coupled to or integrally formed with the lid portion 104. In one embodiment, the cam assembly 138 is made from 40% reinforced polypropylene material molded integrally with the lid portion 104; however other materials may be used for the cam assembly 138 or the lid portion 104. The cam assembly 138 includes a number of cam features or guide surfaces 192 that operate as ramps for cam followers 194 (FIG. 6B) to control the direction and overall distance traveled for each of the arms 142, 144. Referring briefly to FIGS. 3A and 6B, the cam followers 194 are attached to the secondary arms 144, which in turn couple the primary arms 142 to the driven gear 134. The cam features 192 provide a smooth transition of the linkage assembly as the container 100 is changed from a sealed to a non-sealed configuration, or vice-versa.

The cam followers 194 are located adjacent to the cam features 192 and the driven gear 134 (FIG. 3A). In addition, a number of stops 196 (FIG. 3B) may be attached or integrally formed with the cam features 192. The stops 196 provide a positive method of controlling the amount of rotational movement of the driven gear 134, which in turn prevents the primary arms 142 from traveling too far over center, loosing too much tension, or generating too much tension.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. An equipment container comprising:

a base portion forming a containment space to receive equipment;

a molded lid portion coupleable to the base portion, the molded lid portion having a plurality of guide channels; and a sealing system located proximate an interior surface of the molded lid portion, the sealing system comprising:

a rotatable latch coupled to a drive gear;

a driven gear engaging the drive gear;

a linkage assembly having first links pivotally coupled to the driven gear and second links each having first end portions pivotally coupled to the respective first links and second end portions received by the respective guide channels, wherein the guide channels define a travel path for the second end portions, the linkage assembly further having movable internal latch mechanisms coupled to the second end portions of the second links, the movable internal latch mechanisms operable to sealingly compress a seal located between the base portion and the molded lid portion with a desired amount of rotation applied to the rotatable latch, wherein the sealing system moves between an open state and a closed state as the second end portions along the travel path; and a cam assembly including a plurality of sloped surfaces configured to guide a respective plurality of cam followers coupled to the linkage assembly, the driven gear defining a central aperture, the cam assembly being positioned within the central aperture.

2. The equipment container of claim 1, wherein the base portion includes first raised members configured to cooperatively engage second raised members on the lid portion of another container.

3. The equipment container of claim 1, wherein the cam assembly including a plurality of sloped surfaces configured to guide a respective plurality of cam followers coupled to the linkage assembly.

4. The equipment container of claim 1, wherein the cam assembly including a plurality of recesses complementarily shaped to receive the first end portions of the second links.

5. The equipment container of claim 1, wherein the first links are shorter than the second links.

6. The equipment container of claim 1, further comprising a stationary pressure bracket coupled to the lid portion, the stationary pressure bracket arranged to receive and compress a deformable tang when the rotatable latch is rotated.

7. The equipment container of claim 1, further comprising:

a pin coupled to the rotatable latch and further coupled to the drive gear; and a biasing member coupled to the pin and compressible to maintain the pin in alignment with the drive gear.

8. The equipment container of claim 1, wherein the cam assembly further includes stops configured to limit rotation of the driven gear.

9. The equipment container of claim 6, wherein the deformable tangs protrude inwardly from the stationary pressure bracket when the second end portions are in the open state.

10. The equipment container of claim 9, wherein the base portion defines means for engaging the deformable tangs.

11. The equipment container of claim 6, wherein the deformable tangs are coupled to the second end portions by arcuate-shaped sliders conforming to an interior contour of the molded lid portion.

12. A sealing system for a container having a lid portion and a base portion comprising:

a rotatable latch coupled to a drive gear;

a driven gear engaged with the drive gear;

a linkage assembly having first links pivotally coupled to the driven gear and second links each having first end portions pivotally coupled to the respective first links and second end portions coupled to an engagement system that operates to seal the container, the engagement system having deformable tangs coupled to a lid portion of the container and configured to respectively engage brackets coupled to a base portion of the container a cam assembly including a plurality of sloped surfaces configured to guide a respective plurality of cam followers coupled to the linkage assembly, the driven gear defining a central aperture, the cam assembly being positioned within the central aperture.

13. The sealing system of claim 12, wherein the cam assembly has a plurality of sloped surfaces configured to guide a respective plurality of cam followers coupled to the linkage assembly.

14. The sealing system of claim 12, wherein the first links are shorter than the second links.

15. The sealing system of claim 12, further comprising a stationary pressure bracket coupled to the lid portion, wherein the stationary pressure bracket is arranged to receive and compress the deformable tang when the latch is rotated causing the deformable tang to move relative to the stationary pressure bracket.

16. The sealing system of claim 12, further comprising:

a pin coupled to the rotatable latch and further coupled to the drive gear; and a biasing member coupled to the pin and compressible to maintain the pin in alignment with the drive gear.

17. The sealing system of claim 12, further comprising arcuate-shaped sliders coupled to the second links and further coupled to the deformable tangs.

18. A method for sealing a container, the method comprising:

moving a latch mechanism from a first position in which one or more bosses prevent the latch mechanism from rotating into a second position in which the bosses do not prevent the latch mechanism from rotating so that the latch mechanism is in a rotatable position relative to the bosses;

rotating the latch mechanism in a first rotational direction, the latch mechanism coupled to a drive gear;

moving a linkage assembly through rotation of the drive gear, the linkage assembly having a primary arm coupled to the latch mechanism and a secondary arm;

moving a deformable tang into engagement with a fixed bracket responsive to movement of the linkage assembly, the deformable tang coupled to the secondary arm and the fixed bracket coupled to a second portion of the container; and compressing a seal located at an interface of the first portion the second portion of the container, wherein the latch mechanism includes a driven gear and a cam assembly including a plurality of sloped surfaces configured to guide a respective plurality of cam followers coupled to the linkage assembly, the driven gear defining a central aperture, the cam assembly being positioned within the central aperture.

19. The method of claim 18, wherein moving the latch mechanism into the rotatable position includes rotating the latch mechanism about a pin that is coupled to the drive gear.

20. The method of claim 18, wherein rotating the latch mechanism in the first rotational direction includes manually rotating the latch mechanism.

21. The method of claim 18, wherein moving the linkage assembly through rotation of the drive gear includes rotating a driven gear that is engaged with the drive gear.

22. The method of claim 18, wherein the first portion of the container is a lid portion of the container and the second portion of the container is a base portion of the container.

23. The method of claim 18, wherein moving the linkage assembly includes rotating a driven gear to position the secondary arm substantially perpendicular to the primary arm.

24. The method of claim 18, wherein compressing the seal includes placing the deformable tang and the fixed bracket into tension.

* * * * *